US009498663B2

(12) United States Patent
Jeong

(10) Patent No.: US 9,498,663 B2
(45) Date of Patent: Nov. 22, 2016

(54) SPRINKLER HEAD

(71) Applicant: In Jin Jeong, Seoul (KR)

(72) Inventor: In Jin Jeong, Seoul (KR)

( * ) Notice: Subject to any disclaimer, the term of this patent is extended or adjusted under 35 U.S.C. 154(b) by 0 days.

(21) Appl. No.: 14/893,228

(22) PCT Filed: Jun. 10, 2013

(86) PCT No.: PCT/KR2013/005079
§ 371 (c)(1),
(2) Date: Nov. 23, 2015

(87) PCT Pub. No.: WO2014/200124
PCT Pub. Date: Dec. 18, 2014

(65) Prior Publication Data

US 2016/0089556 A1 Mar. 31, 2016

(51) Int. Cl.
*A62C 37/12* (2006.01)
*A62C 35/68* (2006.01)
*B05B 1/26* (2006.01)

(52) U.S. Cl.
CPC ..... *A62C 35/68* (2013.01); *A62C 37/12* (2013.01); *B05B 1/265* (2013.01)

(58) Field of Classification Search
CPC ..... A62C 37/08; A62C 37/10; A62C 37/11; A62C 37/12; A62C 37/14; A62C 37/16; A62C 35/68; B05B 1/26; B05B 1/262; B05B 1/265
USPC ..... 169/38–40, 56, 57
See application file for complete search history.

(56) References Cited

U.S. PATENT DOCUMENTS

| | | | | |
|---|---|---|---|---|
| 1,010,045 | A * | 11/1911 | Hall | A62C 37/12 137/72 |
| 4,376,465 | A | 3/1983 | Simons et al. | |
| 4,570,720 | A | 2/1986 | Retzloff et al. | |
| 4,623,023 | A | 11/1986 | Retzloff | |
| 7,900,852 | B2 | 3/2011 | Feenstra | |
| 2010/0059235 | A1 | 3/2010 | Feenstra | |

FOREIGN PATENT DOCUMENTS

| | | | |
|---|---|---|---|
| KR | 10-2001-0018937 | A | 3/2001 |
| KR | 10-2009-0040643 | A | 4/2009 |

* cited by examiner

*Primary Examiner* — Christopher Kim
(74) *Attorney, Agent, or Firm* — Rabin & Berdo, P.C.

(57) ABSTRACT

The present disclosure provides a sprinkler head which has a structure capable of preventing water leakage and malfunction and can be adapted to automated production. The sprinkler head includes a frame which has a water outlet and is coupled to a water supply pipe so that supply water is discharged through the water outlet, a deflector which has a height adjustment unit in a central portion thereof and is coupled to a lower portion of the frame, a fuse which is supported by the height adjustment unit and has a first lever and a second lever that are coupled with each other by a fusible metal, and a valve cap which is supported by the fuse and closes the water outlet. The first lever and the second lever are welded by the fusible metal at one or more points.

8 Claims, 8 Drawing Sheets

SPRINKLER HEAD

TECHNICAL FIELD

The present disclosure relates to a sprinkler head, and more particularly, to a sprinkler head which sprinkles water in case of fire and extinguishes the fire.

BACKGROUND ART

Generally, sprinklers are installed in high buildings or structures having predetermined sizes or more so that in case of fire, it can be immediately extinguished. Such fire sprinklers are classified into a variety of types according to an installation method and the purpose of use. Depending on shapes, configurations, etc. of sprinkler heads, there may be a ceiling height limit, or a problem of malfunction may be caused.

FIG. 1 is a sectional view showing a sprinkler head according to a conventional technique. The sprinkler head of FIG. 1 is a fuse type sprinkler head using fusible metal.

The sprinkler head according to the conventional technique includes a frame 20, a fuse 50, a valve cap 30, and a deflector 40.

The frame 20 is coupled to a water supply pipe 10 which supplies water to the sprinkler head. The deflector 40 is coupled to a lower end of the frame 20 and functions to spray water supplied from a water outlet 21 of the frame 20 in all directions. A support 41 is coupled to an upper portion of the deflector 40. The valve cap 30 is installed to come into close contact with the water outlet 21 and close the water outlet 2, thus blocking supply water.

The fuse 50 presses the valve cap 30 onto the water outlet 21 so that the valve cap 30 can come into close contact with the water outlet 21 so as to openably close the water outlet 21. The fuse 50 is supported by the support 41. The force with which the fuse 50 presses the valve cap 30 can be adjusted by variation in height of the support 41. The fuse 50 includes a lever 51, an eccentric lever 52, and a fusible metal 53 which are installed to support the valve cap 30 in cooperation with each other. The eccentric lever 52 is disposed at an eccentric position displaced from an imaginary line connecting the support 41 and the center of the valve cap 30 with each other.

The operation of the sprinkler head according to the conventional technique will be described below. If fire occurs and the temperature of a room increases, the fusible metal 53 is exposed to high temperature. When the fusible metal 53 is heated to a predetermined temperature or more, the fusible metal 53 is melted. Then, balance between the levers 51 and 52 is lost. The levers 51 and 52 are thus separated from each other. Hence, the pressure that is applied to the valve cap 30 is removed. The valve cap 30 is therefore removed from the water outlet 21, whereby the water outlet 21 opens. Consequently, supply water is discharged out of the sprinkler head.

Typically, sprinkler heads are installed in buildings when the buildings are constructed, and then are semi-permanently used. With regard to the sprinkler head according to the conventional technique, while the levers 51 and 52 are exposed to high pressure of supply water over a long period of time, pressure is continuously applied from the levers 51 and 52 to the fusible metal 53. Thus, the fusible metal 53 may be deformed by the high pressure, and the levers 51 and 52 may be pushed into the fusible metal 53. In this case, the force with which the levers 51 and 52 support the valve cap 30 is reduced, whereby water leakage is caused.

Furthermore, because the eccentric lever is eccentrically disposed and is provided with a plurality of bent parts, the levers 51 and 52 may be easily bent by high pressure, thus causing a problem of water leakage or malfunction.

In addition, the structures of the levers 51 and 52 are complex. The fusible metal 53 and the levers 51 and 52 are separately provided from each other and must be assembled together in a fitting manner. Hence, it is difficult for the sprinkler head to be adapted to automated production.

Moreover, the fusible metal 53 comes into contact with only the edges of ends of the levers 51 and 52, so that a contact area therebetween is comparatively small. Thus, the rate at which heat is transferred to the fusible metal 53 is relatively low. Therefore, the conventional technique cannot be applied to a quick response sprinkler head which must have thermal responsiveness higher than that of a standard response sprinkler head.

DISCLOSURE

Technical Problem

Various embodiments are directed to a sprinkler head which has a structure capable of preventing water leakage.

Also, various embodiments are directed to a sprinkler head which has a structure capable of preventing malfunction.

Further, various embodiments are directed to a sprinkler head which can be easily adapted to automated production.

In addition, various embodiments are directed to a sprinkler head which can be applied to quick response sprinkler equipment.

Technical Solution

A sprinkler head according to the present disclosure includes: a frame including a water outlet and coupled to a water supply pipe so that supply water is discharged through the water outlet; a deflector including a height adjustment unit in a central portion thereof and coupled to a lower portion of the frame; a fuse supported by the height adjustment unit and including a first lever and a second lever which are coupled with each other by a fusible metal; and a valve cap supported by the fuse and closing the water outlet, wherein the first lever and the second lever are welded by the fusible metal at two or more points.

The first lever may have a bent part formed by bending a portion thereof such that an upper plate facing the height adjustment unit is formed on a first end of the bent part, wherein the upper plate may be supported by the height adjustment unit. The second lever may include a first end bent to have an upper surface facing a lower surface of the upper plate, and a second end supporting the valve cap.

The first lever may include: wings bending and protruding downward from respective opposite edges of the upper plate; and wing supports obliquely bending and protruding from respective opposite edges of a lower plate extending from a second end of the bent part, wherein the wings are supported by the respective wing supports.

Support wing parts may protrude from respective opposite edges of the second lever, and the wing supports may be supported by the respective support wing parts.

A stopper may be provided on an end of each of the wing supports such that the stopper comes into contact with an outer surface of the corresponding wing, whereby the wing is prevented from being removed from the wing support. A portion of the bent part may come into contact with an inner surface of each of the wings so that the wing is prevented from being deformed inward.

The wing support may be bent to an angle less than a right angle.

The bent part of the first lever may be bent to have a U shape.

The fusible metal may be disposed between the upper plate of the first lever and the upper surface of the second lever.

A recess-protrusion part may be formed on a portion of the second lever.

A reinforcing part may be formed by bending an end of the upper plate upward.

Advantageous Effects

The disclosed technique may have the following effects. However, it does not mean that a particular exemplary embodiment includes all of, or only, the following effects. Therefore, it should not be understood that the scope of the present disclosure is not limited to the following.

The sprinkler head according to the present disclosure has a structure capable of preventing water leakage and malfunction, can be adapted to automated production, and can be applied to quick response sprinkler equipment.

MODE FOR INVENTION

Hereinafter, an exemplary embodiment of the present disclosure will be described in detail with reference to the attached drawings. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. Specific structural and functional descriptions of embodiments of the present disclosure are only for illustrative purposes of the preferred embodiments of the present disclosure, and the present description is not intended to represent all of the technical spirit of the present disclosure. On the contrary, the present disclosure is intended to cover not only the exemplary embodiments, but also various alternatives, modifications, equivalents and other embodiments that may be included within the spirit and scope of the present disclosure as defined by the appended claims.

Figure 1:
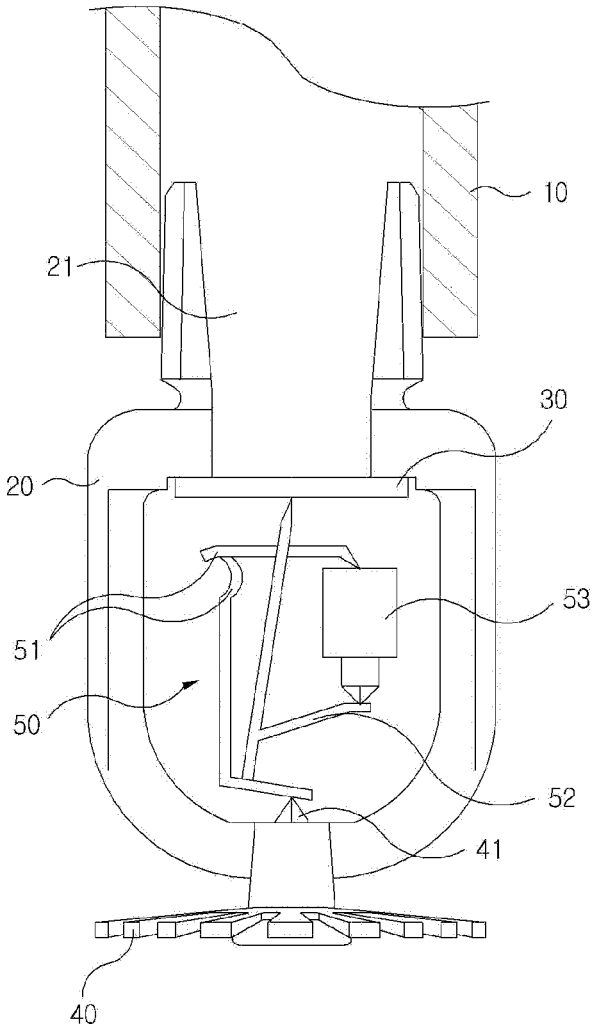
FIG. 1 is a sectional view of a sprinkler head according to a conventional technique.
Figure 2:
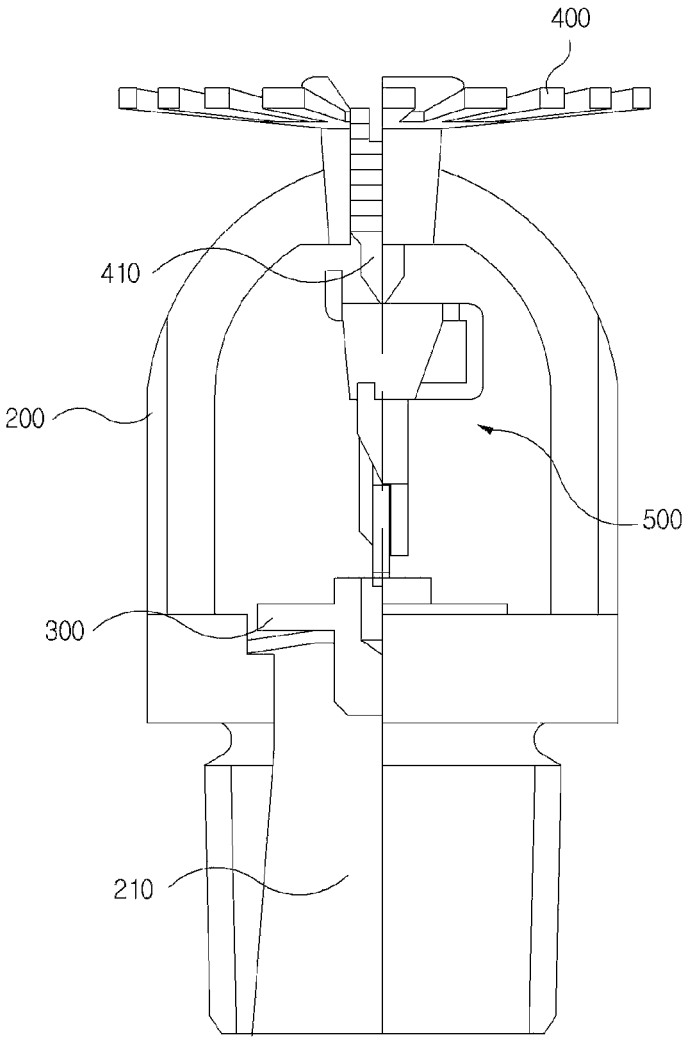
FIG. 2 is a view illustrating a sprinkler head according to an embodiment of the present disclosure.

FIG. 2 is a view illustrating a sprinkler head according to an embodiment of the present disclosure. For the sake of understanding, FIG. 2 shows the sprinkler head turned upside down based on the typical installation orientation of the sprinkler head, which is mounted to a ceiling of a building.

The sprinkler head according to the embodiment of the present disclosure includes a frame 200, a deflector 400, a fuse 500, and a valve cap 300.

The frame 200 is coupled to a water supply pipe 100 so that supply water can be discharged through a water outlet 210 formed in an upper portion of the frame 200.

The deflector 400 functions to sprinkle water discharged from the water outlet 210 into a wide space and is coupled to a lower end of the frame 200. A height adjustment unit facing the water outlet 210 is provided on a central portion of the deflector 400.

The valve cap 300 has a disc shape and closes the water outlet 210 so as to block supply water.

The fuse 500 is disposed between the valve cap 300 and the height adjustment unit, and upper and lower ends thereof are respectively supported by the valve cap 300 and the height adjustment unit. In detail, as the lower end of the fuse 500 is supported by the height adjustment unit, the fuse 500 presses the valve cap 300 to close the water outlet 210. The height adjustment unit may include an external threaded part 410. The fuse 500 can be moved upward by tightening the external threaded part 410 into the frame 200. The pressure applied to the fuse 500 can be adjusted by loosening or tightening the external threaded part 410. Therefore, when the external threaded part 410 is strongly tightened, the water outlet 210 can be reliably closed by the valve cap 300.

Figure 3:
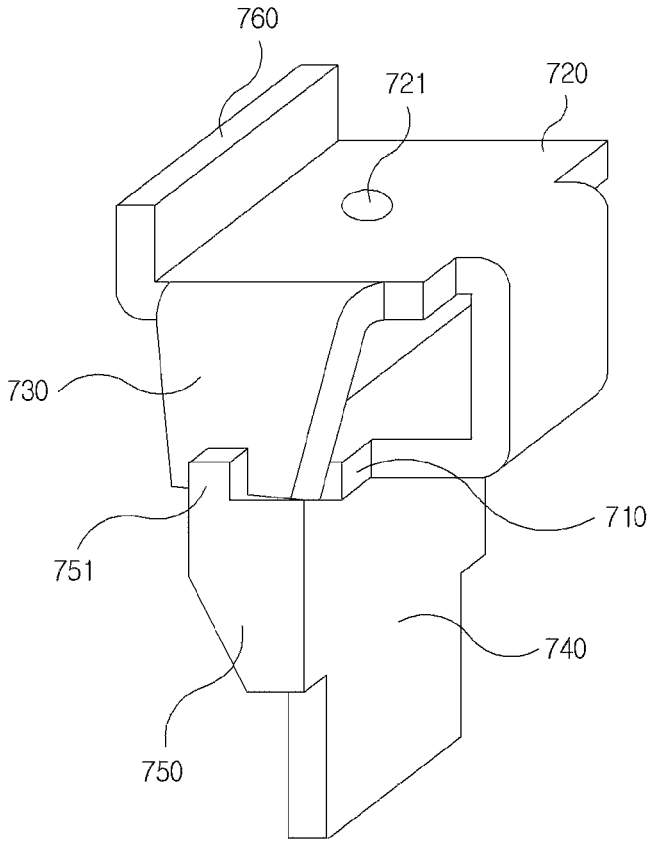
FIG. 3 is a perspective view of a first lever of the sprinkler head according to the embodiment of the present disclosure.
Figure 4:
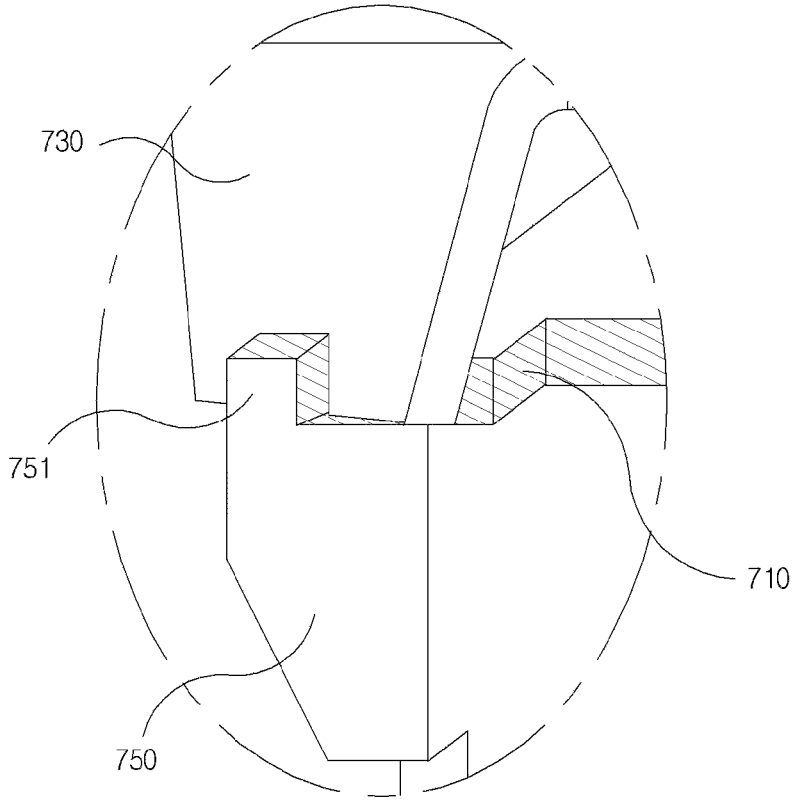
FIG. 4 is an enlarged view of a portion of the first lever of the sprinkler head according to the embodiment of the present disclosure.
Figure 5:
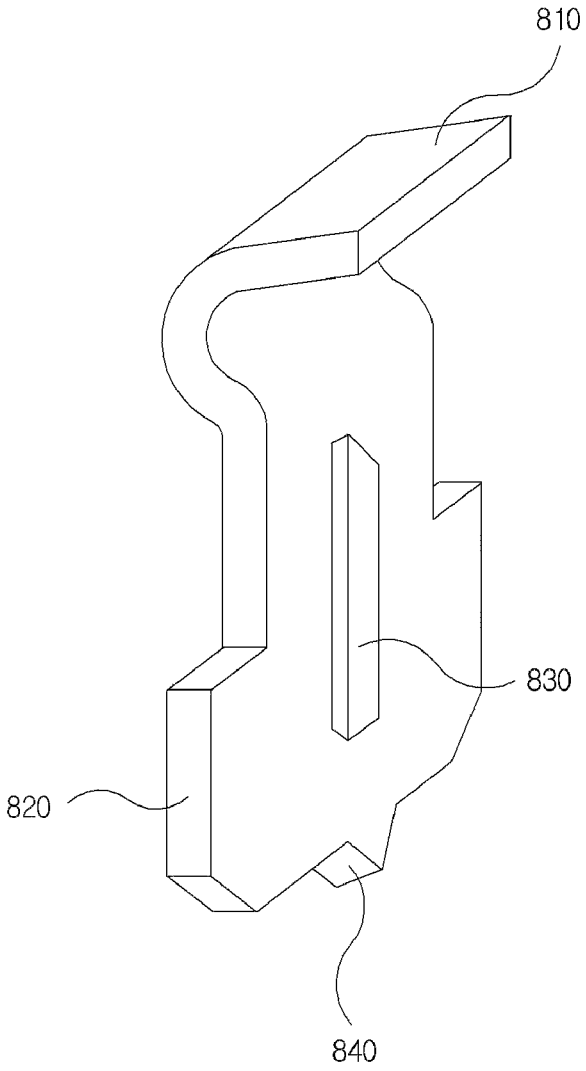
FIG. 5 is a perspective view of a second lever of the sprinkler head according to the embodiment of the present disclosure.
Figure 6:
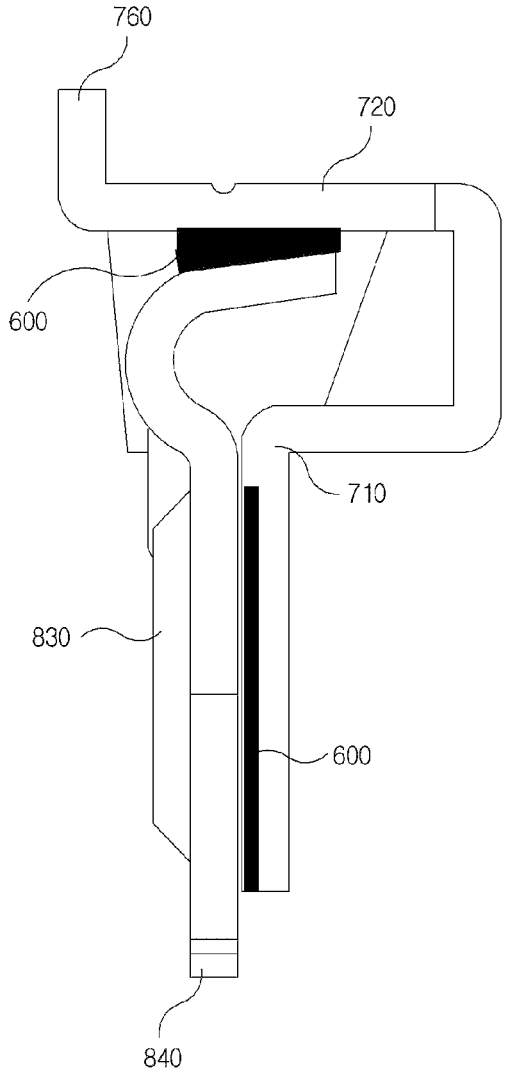
FIG. 6 is a side sectional view of a fuse of the sprinkler head according to the embodiment of the present disclosure.

FIG. 3 is a perspective view of a first lever of the sprinkler head according to the embodiment of the present disclosure. FIG. 4 is an enlarged view of a portion of the first lever of the sprinkler head according to the embodiment of the present disclosure. FIG. 5 is a perspective view of a second lever of the sprinkler head according to the embodiment of the present disclosure. FIG. 6 is a side sectional view of the fuse of the sprinkler head according to the embodiment of the present disclosure.

The fuse 500 includes a first lever 700 and a second lever 800. The first lever 700 and the second lever 800 are coupled with each other by a fusible metal 600.

The first lever 700 includes an upper plate 720 which is formed by bending the first lever 700 such that a side section thereof has a partial U shape, and wings 730 which are formed by bending opposite side parts of the upper plate 720. Furthermore, opposite side parts of a lower plate 740 are obliquely bent toward the respective wings 730, thus forming wing supports 750. Lower ends of the wings 730 and upper ends of the wing supports 750 come into contact with each other, so that when pressure is applied to the wings 730 from the upper plate 720, the wings 730 can be supported by the wing supports 750.

A stopper 751 protrudes from the upper end of each wing support 750 to a predetermined height. The outer surface of each wing 730 is stopped by the corresponding stopper 751. That is, when comparatively high pressure is applied to the wings 730, the wings 730 may be deformed outward and intended to be removed from the wing supports 750. Here, the wings 730 are stopped by the corresponding stoppers 751, whereby the wings 730 can be prevented from being deformed and removed from the wing supports 750. In the present embodiment, to make it possible for each stopper 751 to catch the corresponding wing 730, each wing support 750 may be bent from the lower plate 740 to an angle less than 90° (an acute angle). However, the present disclosure is not limited to this. For example, in another embodiment, the wing supports 750 may further protrude sideways from the lower plate 740 and be bent to 90° or more.

Furthermore, when comparatively high pressure is applied to the wings 730, inner surfaces of the wings 730 are stopped by an intermediate bent part 710. Thereby, the wings 730 can be prevented from being deformed inward. Therefore, even when high pressure is continuously applied to the wings 730 from the upper plate 720 for a long period of time, the wings 730 can be prevented from being deformed outward or inward and thus can be reliably supported on the wing supports 750.

When high pressure is applied from the external threaded part 410 to the upper plate 730 and, particularly, the upper plate 730 is simultaneously exposed to high temperature, the upper plate 730 may be deformed. To prevent this, a reinforcing part 760 may be formed on the upper plate 730. Referring to FIG. 3, the reinforcing part 760 is formed by bending one end of the upper plate 720 and reinforces the end of the upper plate 730, thus preventing the upper plate 730 from being deformed.

The second lever 800 is rounded on an upper end thereof. Support wing parts 820 protrude outward from respective opposite side edges of a lower portion of the second lever 800. A recess-protrusion part 830 is formed on a central portion of the second lever 800. The recess is formed by recessing a portion of one surface of the second lever 800. The protrusion is formed on the other surface of the second lever 800 by forming the recess. Therefore, the second lever 800 can have strong resistance to deformation due to external force.

The first lever 700 and the second lever 800 are weld by the fusible metal 600. The lower plate 740 of the first lever 700 and the central portion of the second lever 800 are welded by the fusible metal 600. A lower surface of the upper plate 720 of the first lever 700 and an upper surface 810 of the second lever 800 are welded by the fusible metal 600. That is, the first lever 700 and the second lever 800 are bonded to each other at two positions by the fusible metal 600. An upper end of each support wing part 820 come into a lower end of the corresponding wing support 750 and thus supports the wing support 750. Therefore, when pressure is applied from the upper plate, the wing supports 750 can be supported by the respective support wing parts 820. Thereby, the first lever 700 can be reliably supported by the second lever 800. Furthermore, the upper plate 720 of the first lever 700 can be supported by the upper surface 810 of the second lever 800 through the fusible metal 600.

That is, even when strong external force is applied from the external threaded part, the first lever 700 can be reliably supported by the support wing parts 820 and the upper surface 810 of the second lever 800, and the first lever 700 or the second lever 800 can be prevented from being deformed. Consequently, the bonding using the fusible metal 600 can be prevented from being damaged due to external force.

In an embodiment of the present disclosure, the fusible metal 600 may be formed of low-temperature lead which melts at a temperature lower than the melting temperature (about 327°) of typical lead so that in case of fire, the fusible metal 600 can rapidly respond to the fire. In another embodiment of the present disclosure, the fusible metal 600 may be formed of typical lead, a fusible alloy, solder, or an alloy of lead and metal such as thallium (Tl), polonium (Po), bismuth (Bi), etc. which has a melting point lower than that of lead.

A depression 721 is formed in the upper plate 720 of the first lever 700 so that the external threaded part 410 is fitted into the depression 721 and thus coupled to the upper plate 720. A protrusion 840 is provided under the lower end of the second lever 800. The protrusion 840 of the second lever 800 is fitted into a depression formed in a central portion of the valve cap 300. Thereby, the fuse 500 installed in the sprinkler head can be prevented from being pushed outward and displaced from its original position.

Figure 7:
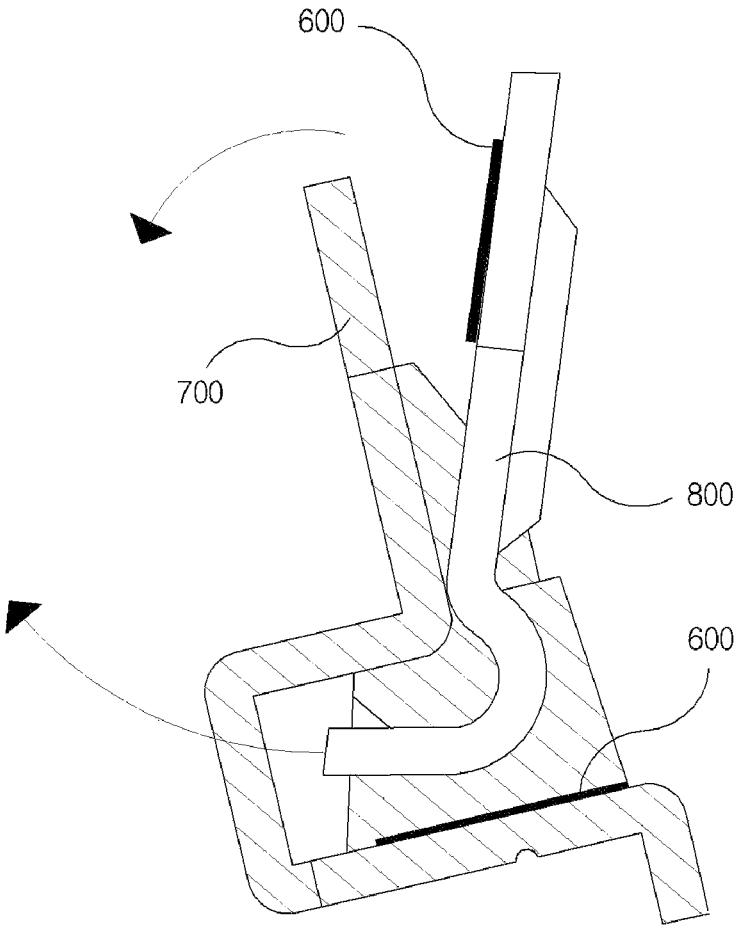
FIG. 7 is a view illustrating disassembly of the fuse of the sprinkler head according to the embodiment of the present disclosure.
Figure 8:
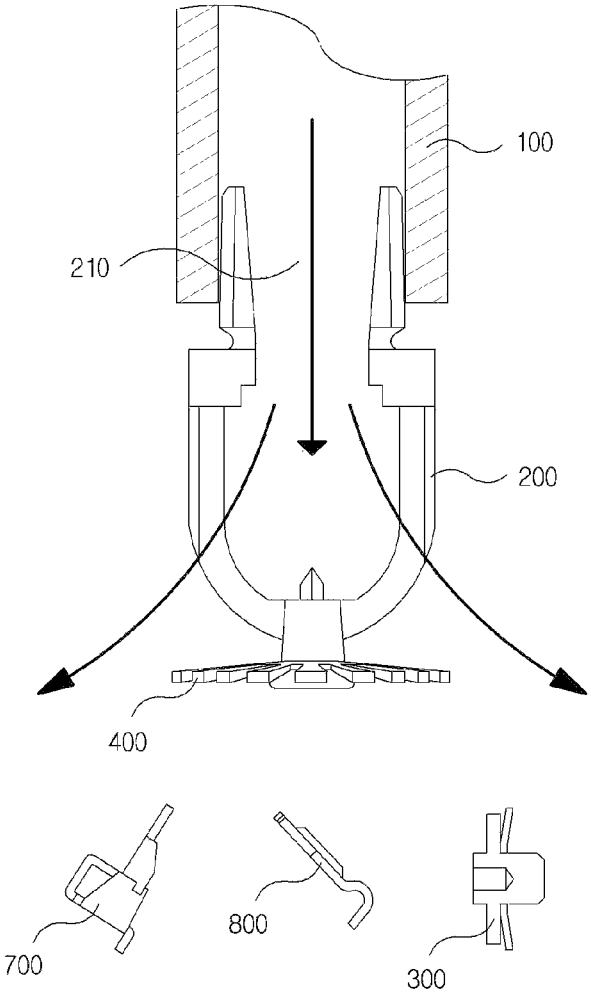
FIG. 8 is a view showing the operation of the sprinkler head according to the embodiment of the present disclosure.

FIG. 7 is a view illustrating disassembly of the fuse of the sprinkler head according to the embodiment of the present disclosure. FIG. 8 is a view showing the operation of the sprinkler head according to the embodiment of the present disclosure. In case of fire, heat is transferred to the fusible metal 600. When the temperature of the fusible metal 600 exposed to high temperature is increased to the melting temperature thereof, the fusible metal 600 melts. Then, the first lever 700 and the second lever 800 are separated from each other so that the force with which the first and second levers 700 and 800 support the valve cap 300 is removed. Thus, the valve cap 300 is removed from the water outlet 210, whereby supply water is discharged from the water outlet 210.

In the sprinkler head according to the conventional technique, while the lever is exposed to high pressure resulting from the pressure of supply water for a long period of time, pressure is continuously applied from the lever to the fusible metal. Thereby, the fusible metal may be deformed, and the lever may be pushed into the fusible metal. In this case, as the force with which the lever supports the valve cap is reduced, water leakage may be caused.

Furthermore, because the eccentric lever is eccentrically disposed and is provided with the bent parts, the levers may be bent by pressure, thus causing a problem of water leakage or malfunction.

In addition, the structures of the levers are complex. Since the fusible metal and the levers are separately formed from each other, they must be assembled with each other by fitting. Therefore, the conventional technique cannot be adapted to automated production.

Moreover, only the edges of the ends of the levers make contact with the fusible metal. Thus, the contact area between the levers and the fusible metal is comparatively small, so that the rate at which heat is transferred to the fusible metal is low. Therefore, the conventional technique cannot be applied to a quick response sprinkler head which must have thermal responsiveness higher than that of a standard response sprinkler head.

However, in the sprinkler head according to the present disclosure, the wings 730 of the first lever 700 are supported by the respective wing supports 750 and can be prevented from being removed from the wing supports 750 thanks to the stoppers 751 and the intermediate bent parts 710. Furthermore, the wing supports 750 are supported by the respective support wing parts 820 of the second lever 800. The upper plate 720 of the first lever 700 is supported by the upper surface 810 of the second lever 800. The recess-protrusion part 830 is formed on the second lever 800. Hence, the first and second levers 700 and 800 can reliably and stably support the valve cover 300. In addition, the reinforcing part 760 reliably supports the upper plate 730, thus preventing the upper plate 730 from being deformed.

Furthermore, because the first lever 700 and the second lever 800 are welded at two points by the fusible metal 600, bonding force between the first and second levers 700 and 800 is strong, and high impact resistance can be provided. In addition, the levers can reliably support the valve cap 300 on a center line connecting the valve cap 300 and the height adjustment unit with each other rather than being eccentrically disposed. Therefore, the fuse can be prevented from being deformed, so that water leakage which may be caused by a reduction in force for supporting the valve cap 300 can be prevented, and the sprinkler head can be prevented from malfunctioning because of deformation of the fusible metal 600.

Furthermore, the fuse is formed in such a way that two levers are integrated with each other by coupling the facing surfaces of the levers to each other using the fusible metal 600. Therefore, the fuse can be easily adapted to mass production.

Moreover, the fusible metal 600 is welded to the levers in such a way that the fusible metal 600 makes surface contact with the levers. Thus, the rate at which heat is transferred to the fusible metal 600 is comparatively high. Therefore, the sprinkler head according to the present disclosure can be applied not only to standard response sprinkler equipment but also to quick response sprinkler equipment.

The technical spirits described in the embodiments of the present disclosure may be independently embodied or be combined with each other. Furthermore, although the exemplary embodiments of the present disclosure have been disclosed, those skilled in the art will appreciate that various modifications, additions and substitutions are possible, without departing from the scope and spirit of the disclosure.

INDUSTRIAL APPLICABILITY

The present disclosure can be used for a sprinkler for extinguishment.

What is claimed is:

1. A sprinkler head comprising:

a frame including a water outlet and coupled to a water supply pipe so that supply water is discharged through the water outlet;

a deflector including a height adjustment unit in a central portion thereof and coupled to a lower portion of the frame;

a fuse supported by the height adjustment unit and including a first lever and a second lever which are coupled with each other by a fusible metal; and a valve cap supported by the fuse and closing the water outlet, wherein the first lever and the second lever are welded by the fusible metal at one or more points, wherein the first lever has a bent part formed by bending a portion thereof such that an upper plate facing the height adjustment unit is formed on a first end of the bent part, the upper plate being supported by the height adjustment unit, wherein the second lever includes a first end bent to have an upper surface facing a lower surface of the upper plate, and a second end supporting the valve cap, and wherein the first lever comprises: wings bending and protruding downward from respective opposite edges of the upper plate; and wing supports protruding from respective opposite edges of a lower plate extending from a second end of the bent part, wherein the wings are supported by the respective wing supports.

2. The sprinkler head according to claim 1, wherein support wing parts protrude from respective opposite edges of the second lever, and the wing supports are supported by the respective support wing parts.

3. The sprinkler head according to claim 1, wherein:

a stopper is provided on an end of each of the wing supports such that the stopper comes into contact with an outer surface of the corresponding wing, whereby the wing is prevented from being removed from the wing support; and a portion of the bent part comes into contact with an inner surface of each of the wings so that the wing is prevented from being deformed inward.

4. The sprinkler head according to claim 3, wherein the wing support is bent to an angle less than a right angle.

5. The sprinkler head according to claim 1, wherein the bent part of the first lever is bent to have a U shape.

6. The sprinkler head according to claim 1, wherein the fusible metal is disposed between the upper plate of the first lever and the upper surface of the second lever.

7. The sprinkler head according to claim 1, wherein a recess-protrusion part is formed on a portion of the second lever.

8. A sprinkler head comprising:

a frame including a water outlet and coupled to a water supply pipe so that supply water is discharged through the water outlet;

a deflector including a height adjustment unit in a central portion thereof and coupled to a lower portion of the frame;

a fuse supported by the height adjustment unit and including a first lever and a second lever which are coupled with each other by a fusible metal; and a valve cap supported by the fuse and closing the water outlet, wherein the first lever and the second lever are welded by the fusible metal at one or more points, wherein the first lever has a bent part formed by bending a portion thereof such that an upper plate facing the height adjustment unit is formed on a first end of the bent part, the upper plate being supported by the height adjustment unit, wherein the second lever includes a first end bent to have an upper surface facing a lower surface of the upper plate, and a second end supporting the valve cap, and wherein a reinforcing part is formed by bending an end of the upper plate upward.

* * * * *